US007383781B1

(12) United States Patent
Griffin

(10) Patent No.: US 7,383,781 B1
(45) Date of Patent: Jun. 10, 2008

(54) DRIVE UNITS, DRIVE SYSTEMS AND BOAT LIFT SYSTEMS INCLUDING THE SAME

(75) Inventor: William Bradley Griffin, LaGrange, NC (US)

(73) Assignee: Tide Tamer Industries, Inc., Snow Hill, NC (US)

( * ) Notice: Subject to any disclaimer, the term of this patent is extended or adjusted under 35 U.S.C. 154(b) by 0 days.

(21) Appl. No.: 11/626,738

(22) Filed: Jan. 24, 2007

Related U.S. Application Data

(60) Provisional application No. 60/772,010, filed on Feb. 10, 2006.

(51) Int. Cl.
*B63C 7/00* (2006.01)

(52) U.S. Cl. ..... 114/44; 254/345; 405/1

(58) Field of Classification Search ..... 114/44, 114/45, 48; 254/345, 344, 347, 356, 371; 405/1, 2, 3, 4
See application file for complete search history.

(56) References Cited

U.S. PATENT DOCUMENTS

| | | | | |
|---|---|---|---|---|
| 2,042,480 | A * | 6/1936 | Patterson, Jr. | 254/345 |
| 3,034,767 | A | 5/1962 | Gordon | |
| 4,004,780 | A * | 1/1977 | Kuzarov | 254/345 |
| 5,211,124 | A | 5/1993 | Reiser | |
| 5,287,821 | A * | 2/1994 | Godbersen | 114/44 |
| 5,772,360 | A | 6/1998 | Wood, II | |
| 5,810,508 | A | 9/1998 | Norfolk et al. | |
| 5,839,851 | A | 11/1998 | Norfolk et al. | |
| 5,957,623 | A | 9/1999 | Sargent et al. | |
| 5,970,813 | A | 10/1999 | Parkins et al. | |
| 6,021,692 | A | 2/2000 | Norfolk et al. | |
| 6,033,148 | A | 3/2000 | Norfolk et al. | |
| 6,122,994 | A | 9/2000 | Norfolk et al. | |
| 6,397,691 | B1 | 6/2002 | Greene | |
| 6,408,776 | B1 | 6/2002 | McLaughlin et al. | |
| 6,435,768 | B1 | 8/2002 | Mansfield | |
| 6,470,816 | B1 | 10/2002 | Golden et al. | |
| 7,117,805 | B2 | 10/2006 | Shackelford, Jr. | |
| 2004/0035343 | A1 | 2/2004 | Floe et al. | |

* cited by examiner

*Primary Examiner*—Lars A Olson
(74) *Attorney, Agent, or Firm*—Myers Bigel Sibley & Sajovec, P.A.

(57) ABSTRACT

A boat lift system for raising and lowering a boat from and into a body of water includes a cradle, a cable and a drive system. The cradle is configured to hold the boat. The cable is connected to the cradle. The drive system includes a reel, a drive mechanism and a cable slack control mechanism. The reel is configured to receive the cable. The reel is rotatable in each of a winding direction to wind the cable onto the reel to raise the cradle and an unwinding direction to unwind the cable from the reel to lower the cradle. The drive mechanism includes a drive member and a motor operable to forcibly rotate the drive member in each of a raising direction and a lowering direction. The drive member is operatively connected to the reel to rotate the reel in the winding direction when the drive member is rotated in the raising direction, and to controllably rotate the reel and/or permit the reel to rotate in the unwinding direction when the drive member is rotated in the lowering direction. The cable slack control mechanism is operative to selectively decouple the drive member from the reel while the drive motor is rotating the drive member in the lowering direction.

16 Claims, 7 Drawing Sheets

DRIVE UNITS, DRIVE SYSTEMS AND BOAT LIFT SYSTEMS INCLUDING THE SAME

RELATED APPLICATION(S)

The present application claims the benefit of U.S. Provisional Patent Application Ser. No. 60/772,010, filed Feb. 10, 2006, the disclosure of which is incorporated herein by reference in its entirety.

FIELD OF THE INVENTION

The present invention relates to boat lifts and, more particularly, to boat lifts for lowering watercraft into a body of water and lifting the watercraft out of the water.

BACKGROUND OF THE INVENTION

It is often desirable or necessary to remove a boat stored at a dock from the water. For example, during a storm, the boat may be damaged as a result of being banged against the dock by wind, waves or surges. Boats that are stored in the water may experience increased maintenance costs due to the need for more frequent painting, floating objects striking the hull and/or growth of crustaceans on the hull that must be removed.

In view of the foregoing, many boat owners need or desire to store their boats out of the water. In response to this demand, boat yards are available that will store a boat on land in a cradle or in a warehouse and, upon demand, will retrieve and place the boat in the water using a crane, forklift or the like. However, this alternative may be expensive and/or inconvenient.

SUMMARY OF THE INVENTION

According to embodiments of the present invention, a boat lift system for raising and lowering a boat from and into a body of water includes a cradle, a cable and a drive system. The cradle is configured to hold the boat. The cable is connected to the cradle. The drive system includes a reel, a drive mechanism and a cable slack control mechanism. The reel is configured to receive the cable. The reel is rotatable in each of a winding direction to wind the cable onto the reel to raise the cradle and an unwinding direction to unwind the cable from the reel to lower the cradle. The drive mechanism includes a drive member and a motor operable to forcibly rotate the drive member in each of a raising direction and a lowering direction. The drive member is operatively connected to the reel to rotate the reel in the winding direction when the drive member is rotated in the raising direction, and to controllably rotate the reel and/or permit the reel to rotate in the unwinding direction when the drive member is rotated in the lowering direction. The cable slack control mechanism is operative to selectively decouple the drive member from the reel while the drive motor is rotating the drive member in the lowering direction.

According to some embodiments, the cable slack control mechanism is operative to automatically selectively decouple the drive member from the reel while the drive motor is rotating the drive member in the lowering direction.

According to some embodiments, the cable slack control mechanism is operative to decouple the reel from the drive member when a tension on the cable does not exceed a threshold tension and/or the cable is fully unwound from the reel while the drive motor is rotating the drive member in the lowering direction. According to some embodiments, the threshold tension is zero tension.

According to embodiments of the present invention, a drive system for use with a cradle, a cable and a reel, the cradle being configured to hold the boat, the cable being connected to the cradle, and the reel being configured to receive the cable and rotatable in each of a winding direction to wind the cable onto the reel to raise the cradle and an unwinding direction to unwind the cable from the reel to lower the cradle, is provided for raising and lowering a boat from and into a body of water. The drive mechanism includes a drive member and a motor operable to forcibly rotate the drive member in each of a raising direction and a lowering direction. The drive member is adapted to be operatively connected to the reel to rotate the reel in the winding direction when the drive member is rotated in the raising direction, and to controllably rotate the reel and/or permit the reel to rotate in the unwinding direction when the drive member is rotated in the lowering direction. The cable slack control mechanism is operative to selectively decouple the drive member from the reel while the drive motor is rotating the drive member in the lowering direction.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE PRESENT INVENTION

Figure 1:
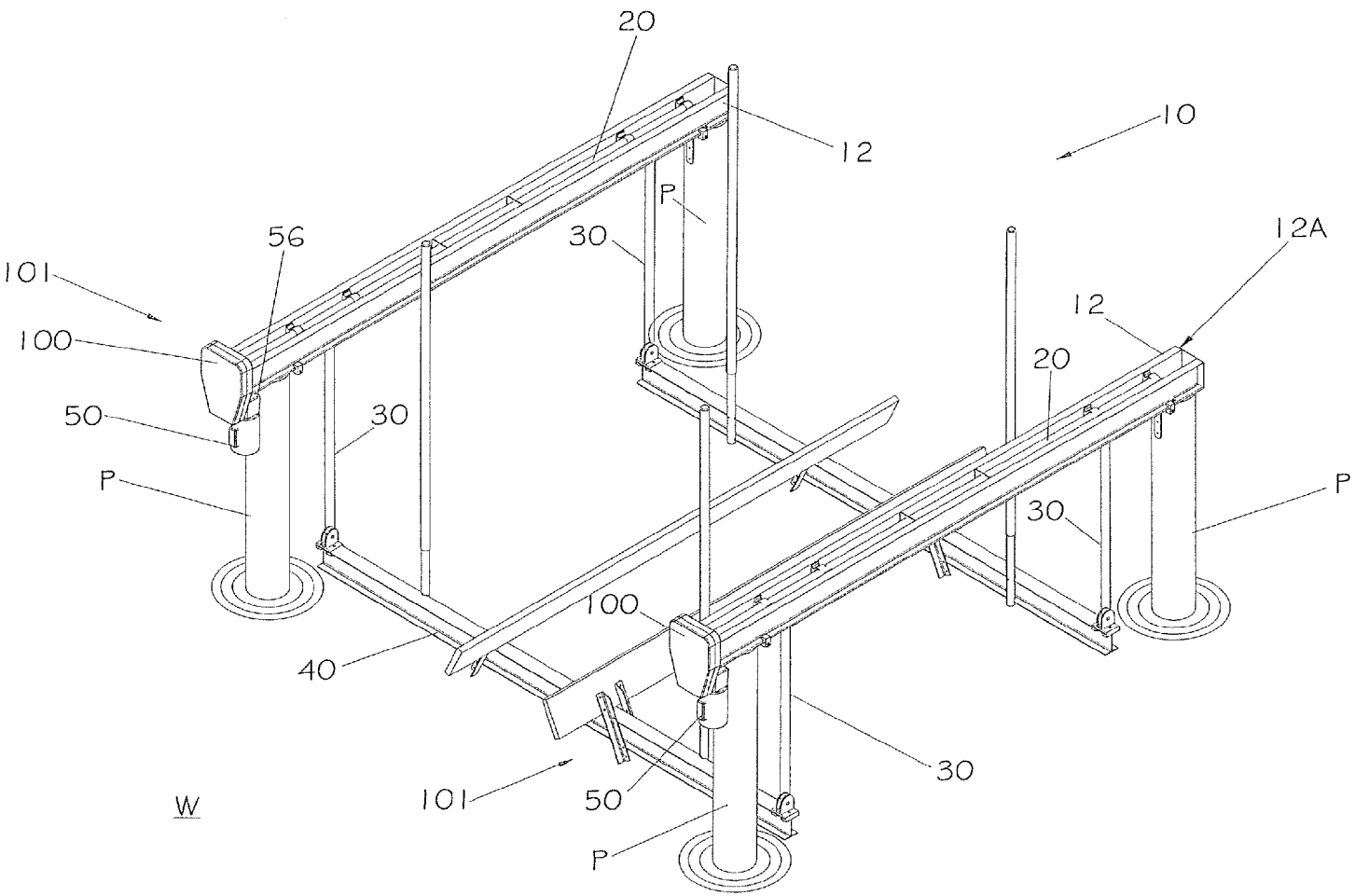
FIG. 1 is a perspective view of a boat lift system according to embodiments of the present invention.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
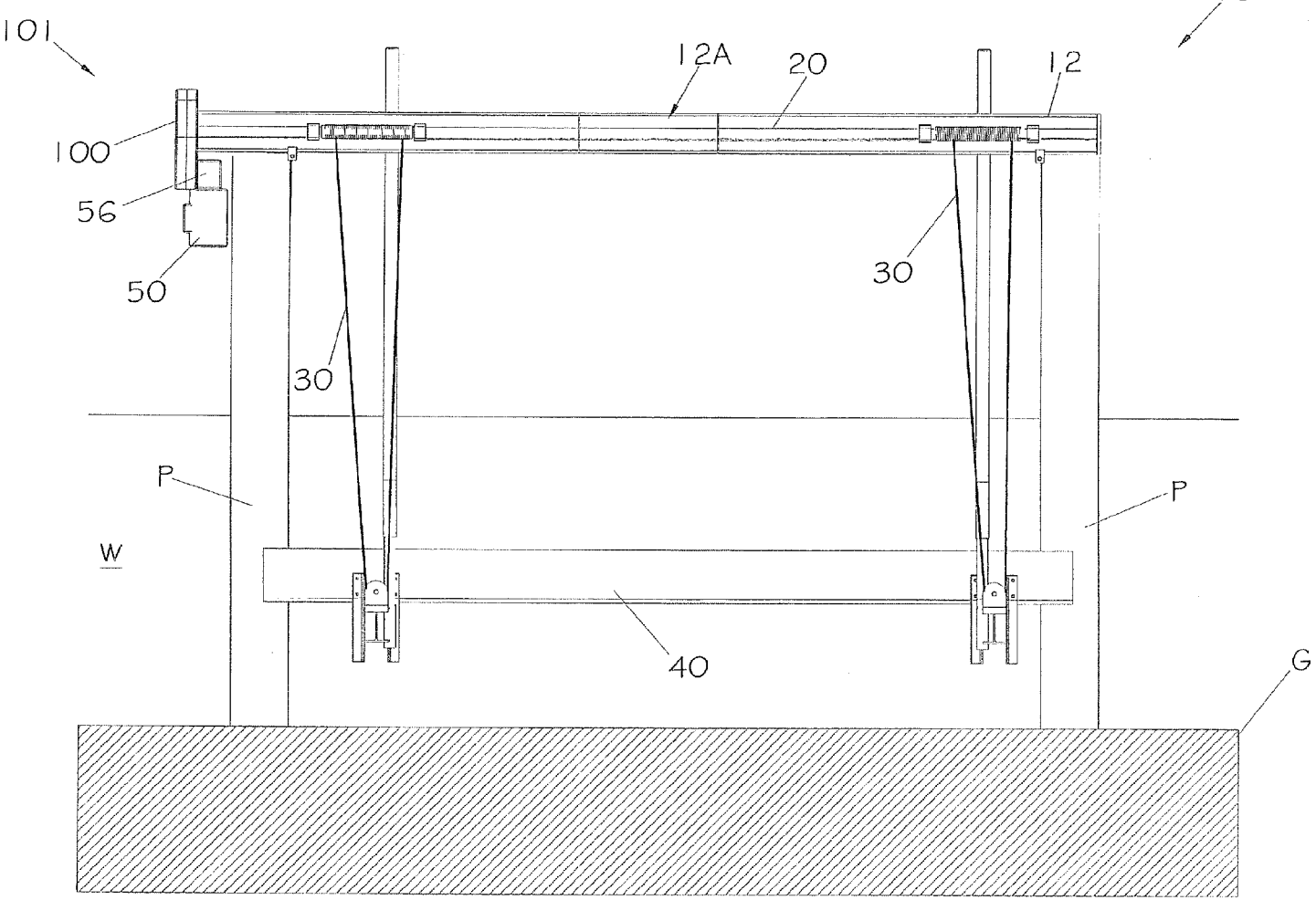
FIG. 2 is a fragmentary, side view of the boat lift system of FIG. 1.
Figure 3:
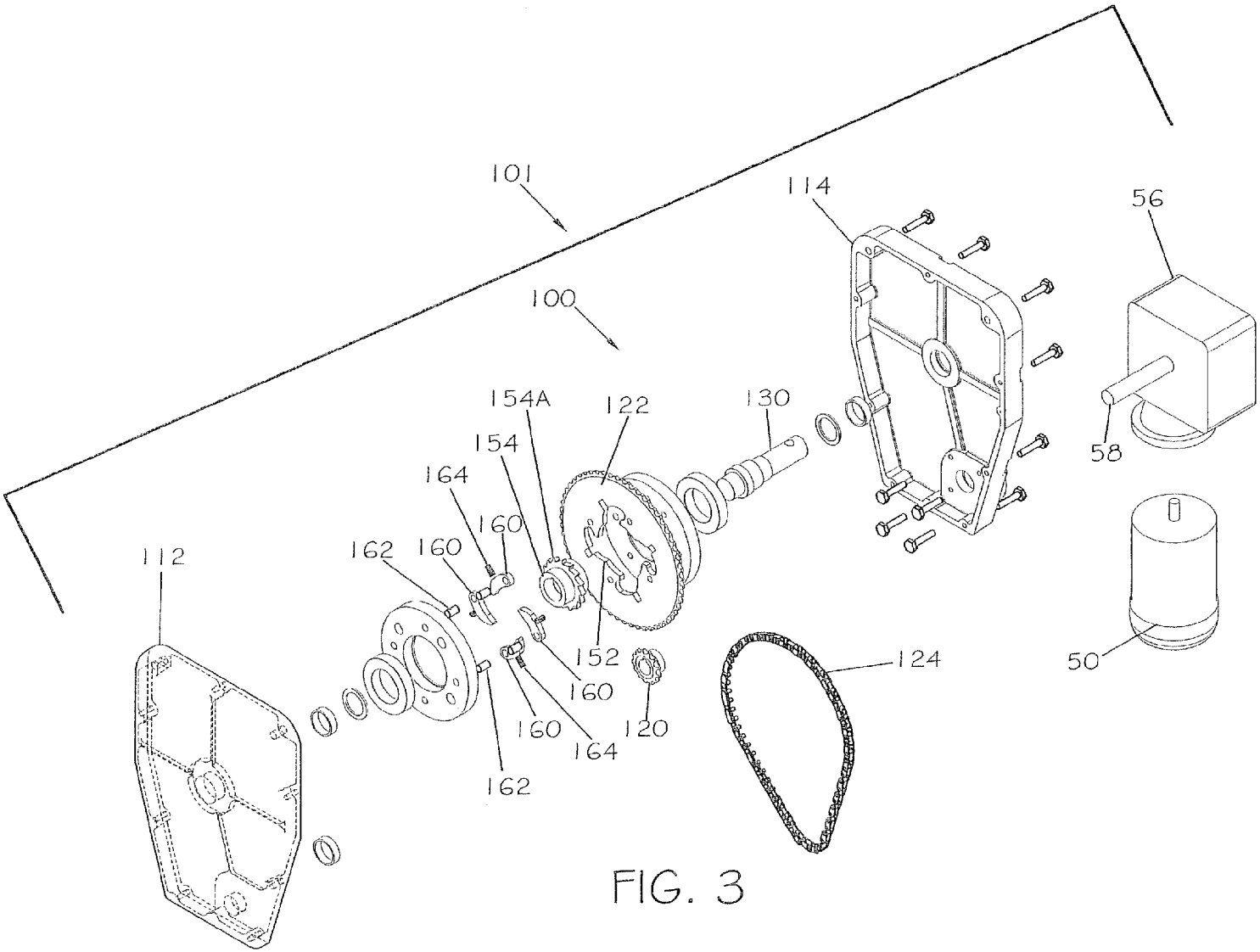
FIG. 3 is a front, exploded, perspective view of a drive system forming a part of the boat lift system of FIG. 1.
Figure 4:
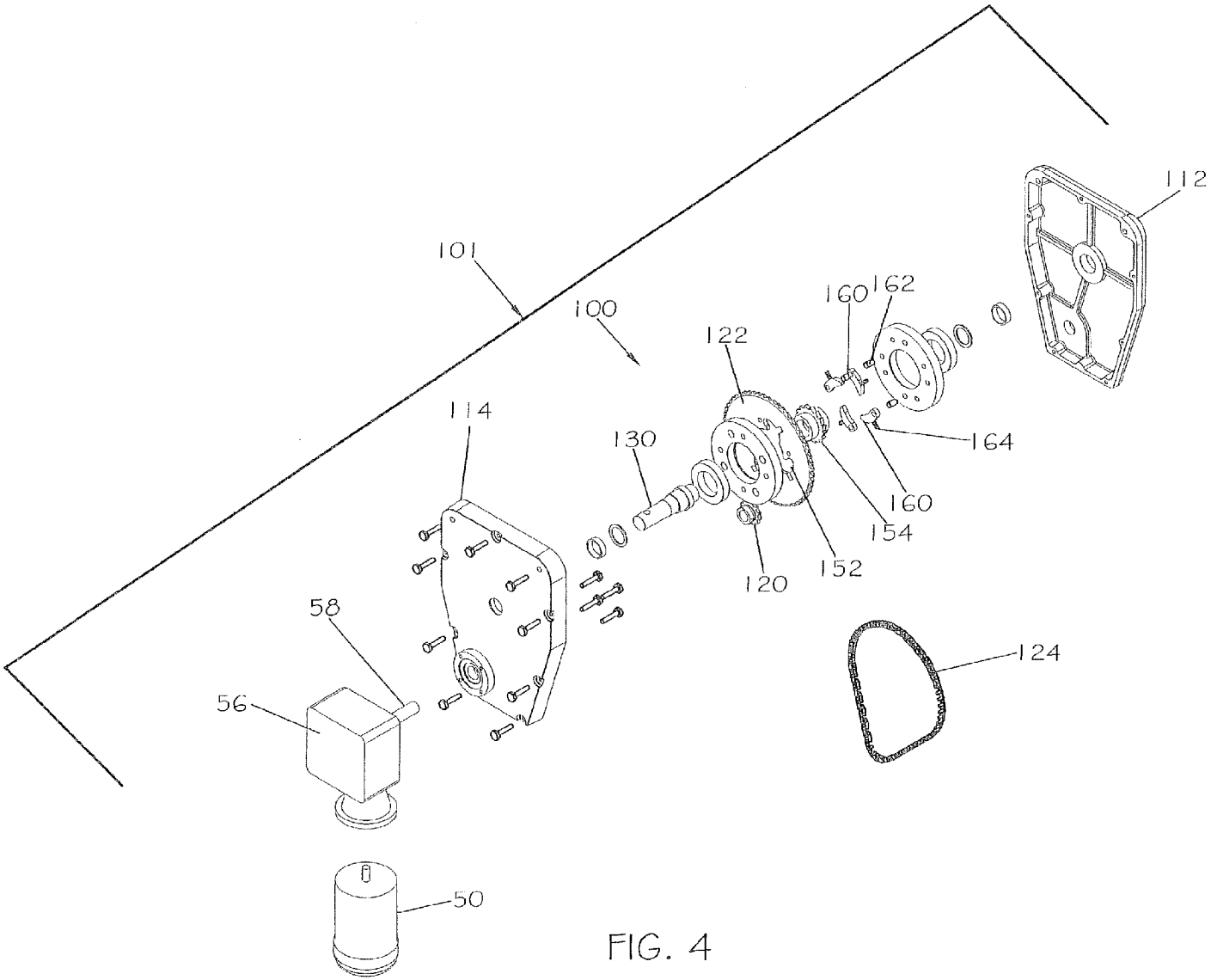
FIG. 4 is a rear, exploded, perspective view of the drive system of FIG. 3.

With reference to FIGS. 1 and 2, a boat lift system 10 according to embodiments of the present invention is shown therein. The boat lift system 10 includes a pair of drive systems 101 according to embodiments of the present invention. Each drive system 101 includes a drive unit 100 according to embodiments of the invention.

The boat lift system 10 includes a pair of channel beams 12 mounted on top of and spanning four pilings P. A reel 20 (e.g., a pipe) is rotatably mounted in a channel 12A of each beam 12. In FIG. 2, the side wall of the proximate beam 10 is removed to show the reel 20. Four cables 30 are attached to the reels 20 as shown. According to some embodiments, the reels 20 include helical grooves formed on their outer surfaces to windingly receive the cables 30. Each cable 30 has an upper end attached to its associated reel 20 and a lower end attached to a cradle 40. The cradle 40 is adapted to receive and support a boat or the like. It will be appreciated that other configurations of the cradle, reel, cables etc. may be employed in accordance with other embodiments of the invention. For example, according to some embodiments, each cable can be attached at both ends to the reel and looped through a pulley secured to the cradle.

Each drive system 101 is mounted on a respective one of the channel beams 12. Each drive system 101 includes a motor 50, a gear reducer 56, and a drive unit 100. Each drive unit 100 has a drive shaft 130 that is coupled to the associated reel 20. Generally, in use, the motors 50 can be selectively actuated to drive their associated drive units 100, which in turn rotate the reels 20 in a given direction. The motors 50 may be reversible motors so that the reels 20 can be selectively rotated in each of two alternative directions, such as a clockwise direction and a counterclockwise direction. In the illustrated embodiment, when the reels 20 are rotated in the counterclockwise (winding) direction, the cables 30 will be wound onto and about the respective reels 20. When the reels 20 are rotated in the clockwise (unwinding) direction, the cables 30 will be unwound from the respective reels 20. In this way, the cradle 40 can be raised and lowered to raise the boat from the water W and to lower the boat into the water W.

A problem may occur in known boat lifts using cables wound on reels. Namely, when lowering the cradle, the cradle may strike the ground or bottom G and the motor may continue to operate. As a result, the reels continue to rotate, causing slack to occur in the cables. The slacked cables may in turn tend to lift off the reels, which may cause mismatch between the cables and the reels, tangling of the cables, etc. Moreover, if the cables are fully unwound, continued rotation of the reels may cause the cables to reverse wind about the reels, which may likewise cause damage and inconvenience.

Boat lifts according to embodiments of the present invention can prevent or inhibit occurrence of the foregoing problems. Each drive unit 100 includes a clutch or cable slack control mechanism 150, as described in more detail below. The boat lift system 10 is adapted such that when the cradle 40 is being lowered and the cables 30 become untensioned, the cable slack control mechanism 150 will decouple the reel 20 from the output of the motor 50 such that the reel 20 is no longer forcibly rotated in the unwinding direction. According to some embodiments, the cable slack control mechanism will decouple the reel 20 from the output of the motor 50 automatically (i.e., without requiring further action or intervention by the operator).

Referring to FIGS. 3-7, an exemplary drive unit 100 is shown therein. The gear reducer 56 has an output shaft 58 that is driven by the motor 50. The output shaft 58 extends through a housing 110 (which includes a front housing member 112 and a rear housing member 114) and drives a drive sprocket 120 therein. It will be appreciated that other arrangements can be employed for transmitting the force from the motor 50 to the sprocket 120. The sprocket 120 in turn drives a larger driven sprocket 122 via a chain 124. An inner control sprocket 154 is positioned in an opening 152 defined in the larger sprocket 122. The drive shaft 130 is affixed to the inner sprocket 154 and extends out of the housing 110. The drive shaft 130 is detachably coupled to the reel 20 to impart rotation thereto.

The cable slack control mechanism 150 includes the inner sprocket 154 as well as four pawls 160. The pawls 160 are pivotably coupled to the large sprocket 122 by pivot pins 162 and are biased inward (i.e., toward the sprocket 154) by springs 164. The free ends of the pawls 160 are adapted to engage directional teeth 154A of the inner sprocket 154. The numbers, configurations and arrangements of pawls and teeth may differ from those illustrated.

Figure 5:
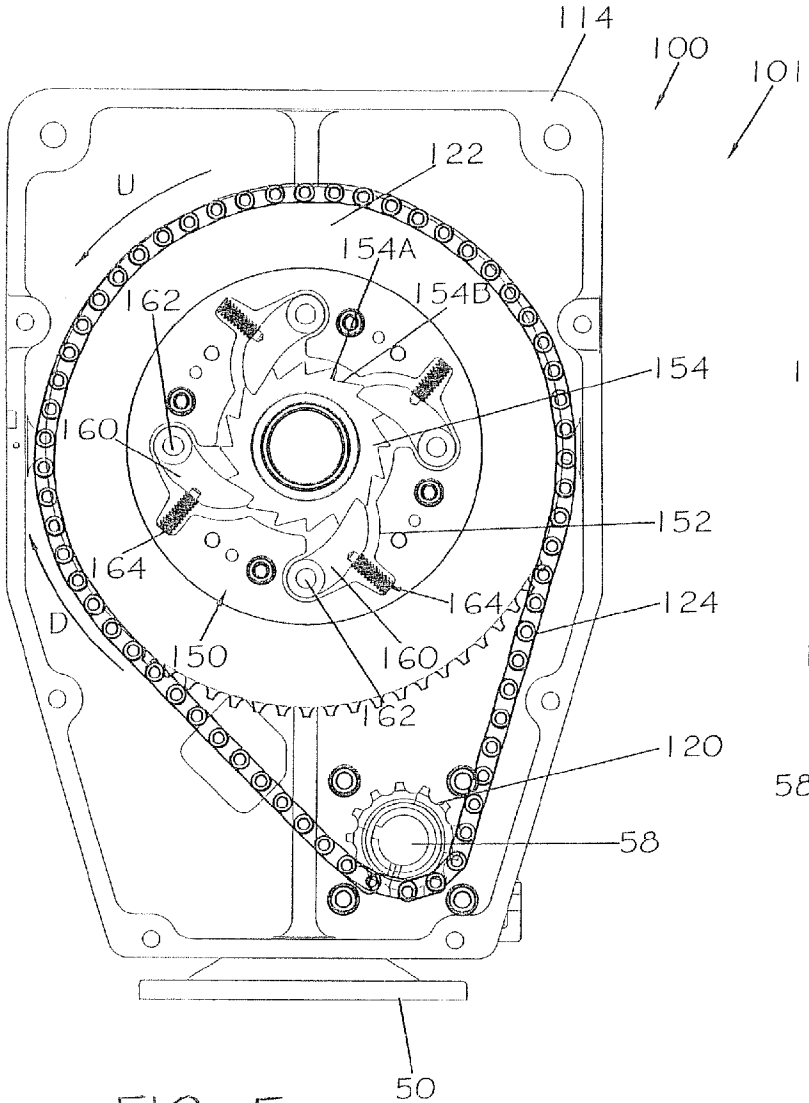
FIG. 5 is a front view of the drive system of FIG. 3 with a front housing member thereof removed.
Figure 7:
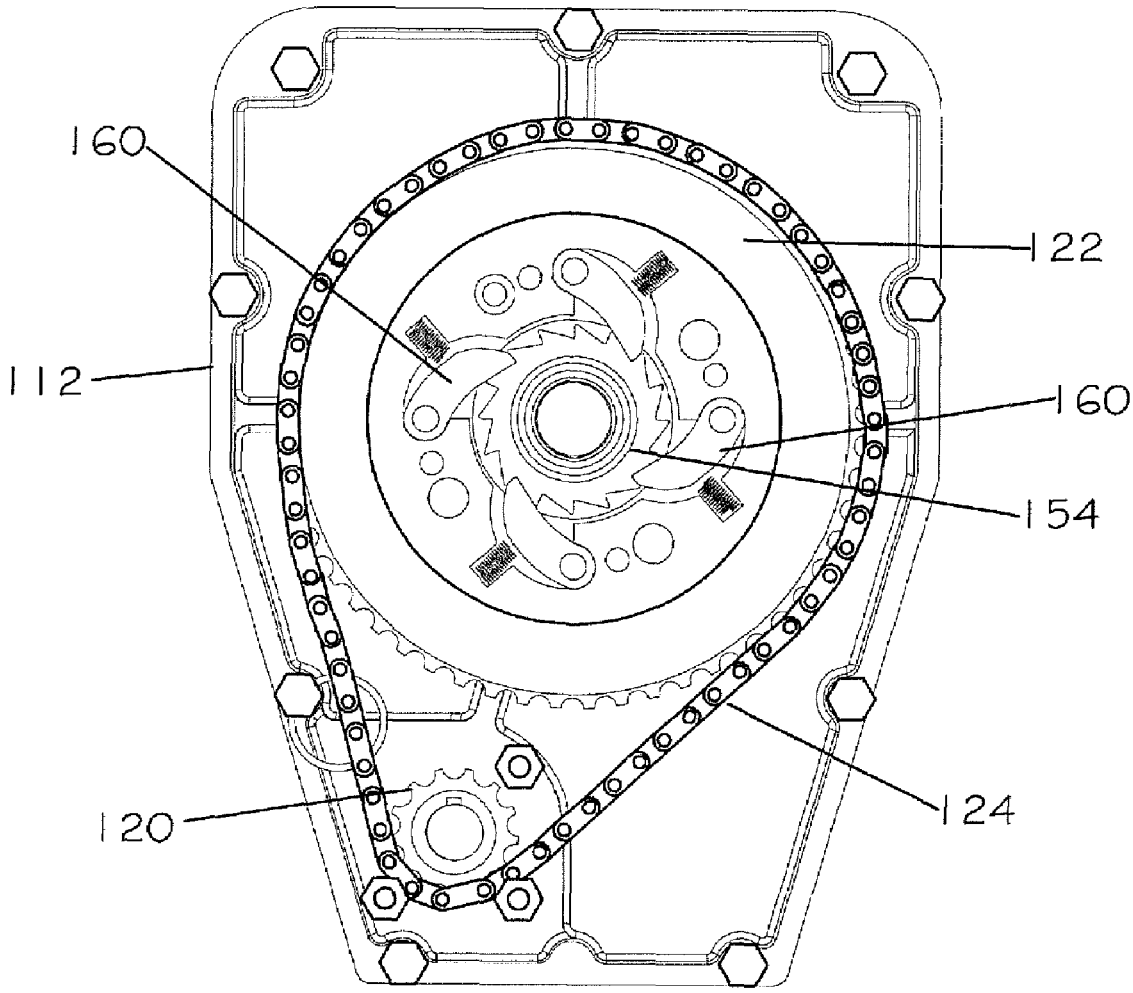
FIG. 7 is a rear view of the drive system of FIG. 3 with a rear housing member thereof removed.

In use, to raise the cradle 40, the motor 50 is actuated to rotate the motor output shaft 58 counterclockwise (from the vantage of FIG. 5). The larger sprocket 122 is thereby rotated in a counterclockwise direction U. The pawls 160 are firmly nested in the directional valleys 154B between the teeth 154A of the inner sprocket 154. Therefore, the drive force from the larger sprocket 122 can be reliably and efficiently transmitted to the inner sprocket 154, which turns the reel 20 to wind up the cable 30.

Once stopped in position, the weight of the cradle 40 (and its contents, if any) will apply a tensioning load to the cable 30. This load will apply a rotational load to the reel 20 in the clockwise direction. However, the engagement between the pawls 160 and the inner sprocket 154 will prevent the reel 20 from rotating clockwise so long as the motor 50 is not actuated.

When the user wishes to lower the cradle 40, the motor 50 is actuated to rotate the output shaft 58 in the clockwise direction. This in turn rotates the larger sprocket 122 in a clockwise direction D, which permits the inner sprocket 154, and thus the reel 20, to rotate in the clockwise direction. The motor 50 will thus permit the cable 30 to unwind from the reel 20 to controllably lower the cradle 40.

If and when the cradle 40 strikes the bottom G, the tension in the cable 30 is thereby removed (i.e., substantially reduced to zero or less). As a result, the clockwise rotational force on the reel 20 from the cable tension will also be removed and will no longer cause the teeth 154A of the inner sprocket 154 to bear against the pawls 160. Rather, the driven larger sprocket 122 will spin freely about the inner sprocket 154. The spring-biased pawls 160 will spin about the inner sprocket 154. While the bias from the springs 164 will cause the pawls 160 to follow the profile of the inner sprocket 154, the pawls 160 will not significantly transmit rotational force from the larger sprocket 122 to the inner sprocket 154. In this manner, the reel 20 is automatically selectively decoupled from the larger sprocket 122 and the motor 50 to prevent or inhibit over-rotation of the reel 20.

The cable slack control mechanism 150 will likewise automatically selectively decouple the reel 20 from the larger sprocket 122 in the event the cable 30 is fully unwound from the reel 20 without striking bottom. In this manner, the cable slack control mechanism 150 prevents or inhibits the cable 30 from being reverse wound onto the reel 20 (i.e., wrapping about the reel 20 in a direction counter to the original winding direction). Such decoupling may occur even if the tension is not removed from the cable 30.

When the direction of the motor 50 is again reversed, the pawls 160 will again securely engage the inner sprocket 154 to again raise the cradle 40.

Accordingly, the cable slack control mechanism 150 may serve as a one-way clutch mechanism that permits and enables normal functionality and operation while preventing or inhibiting a slack-induced failure mode.

According to some embodiments, the cable slack control mechanism will decouple the motor from the reel if and when the tension in the cable (e.g, due to gravity) is zero or less. However, it is also contemplated that the cable slack control mechanism may be configured to decouple the motor from the reel if and when the tension in the cable does not exceed some other prescribed threshold tension.

While some embodiments of the present invention have been described in relation to a boat lift, other water related lift systems are contemplated as well. According to some embodiments, the drive unit is employed with a gangway lift system. A gangway or gangway ramp that is adapted to be lowered into position using a reel and cable system may likewise suffer problems of cable slack if the gangway comes to rest on the bottom G or another impeding structure (e.g., a pier or boat). In accordance with embodiments of the present invention, such a system employs a relief or cable slack control mechanism as described herein.

Figure 6:
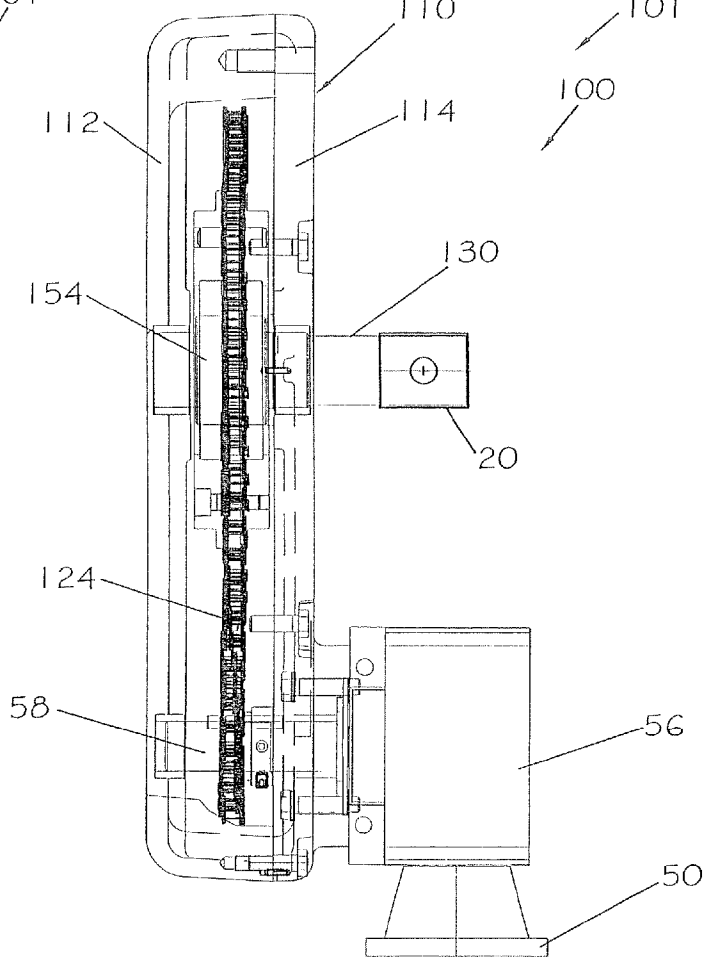
FIG. 6 is a fragmentary, side view of the drive system of FIG. 3.
Figure 8:
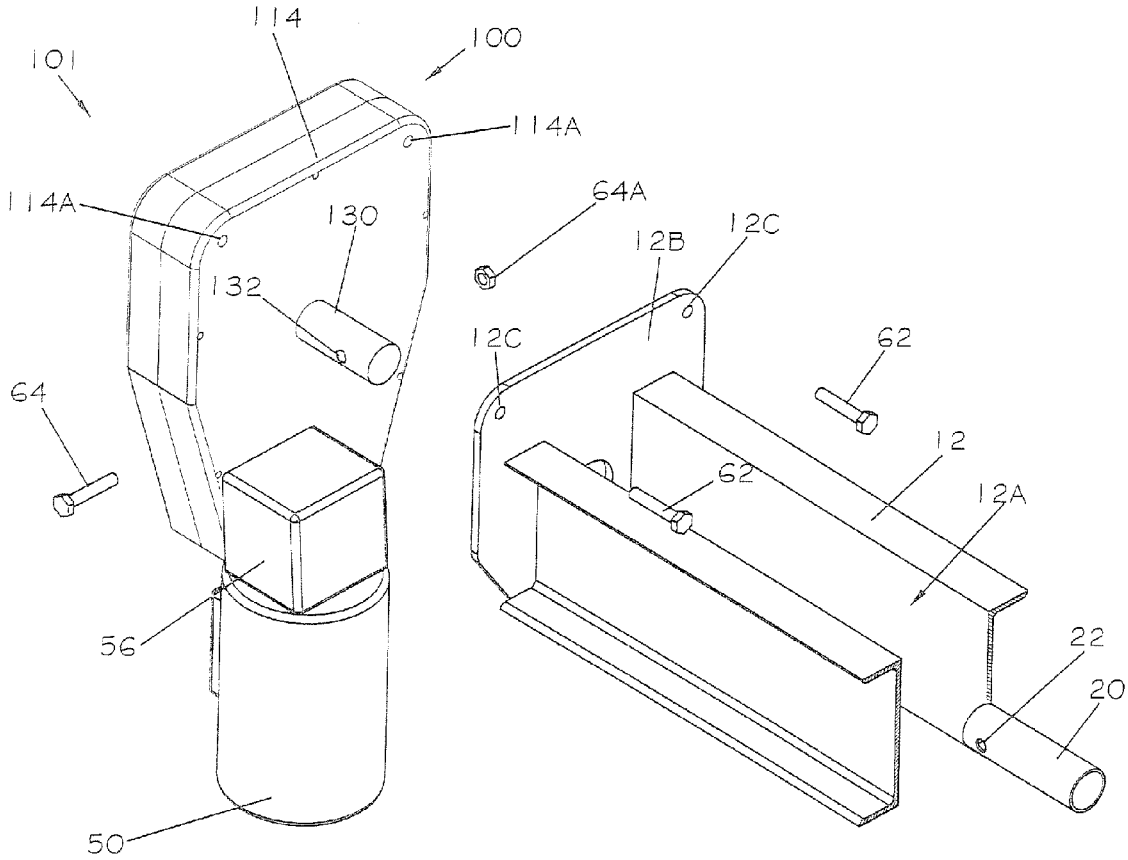
FIG. 8 is an exploded, fragmentary, perspective view of the boat lift system of FIG. 1.

According to some embodiments and as illustrated, the cable slack control mechanism 150 is housed in a modular drive unit housing 110. Furthermore, according to some embodiments, the drive unit 100 can be modularly attached and detached from the remainder of the boat lift system 10. A mounting arrangement according to some embodiments is illustrated in FIG. 8. The drive unit 100 is secured to an end plate 12B of the beam 12 by bolts 62 that extend through holes 12C and are threadedly received in bores 114A in the rear housing member 114. The configuration of the bores 110A may be a standard configuration, allowing the drive unit 100 to be retro-fitted onto the boat lift. The drive shaft 130 extends through an opening 12D and into an open end of the reel 20. A bolt 64 is inserted through a hole 132 in the drive shaft and an aligned hole 22 in the reel 20 and secured by a nut 64A. The motor 50 and the gear reducer 56 are bolted to the drive unit 100 as shown in FIG. 6.

According to other embodiments, the cable slack control mechanism can be relocated outside of the housing. Moreover, according to some embodiments, the cable slack control mechanism can be integrated into the reel 20, the motor output shaft 58 or elsewhere in the drive train.

While two drive systems 101 are shown, boat lifts according to the present invention may have more or fewer drive systems 101.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

What is claimed is:

1. A boat lift system for raising and lowering a boat from and into a body of water, the boat lift system comprising:

a cradle configured to hold the boat;

a cable connected to the cradle; and a drive system including:

a reel configured to receive the cable, the reel being rotatable in each of a winding direction to wind the cable onto the reel to raise the cradle and an unwinding direction to unwind the cable from the reel to lower the cradle;

a drive mechanism including a drive member and a motor operable to forcibly rotate the drive member in each of a raising direction and a lowering direction, wherein the drive member is operatively connected to the reel to rotate the reel in the winding direction when the drive member is rotated in the raising direction, and to controllably rotate the reel and/or permit the reel to rotate in the unwinding direction when the drive member is rotated in the lowering direction; and a cable slack control mechanism operative to selectively decouple the drive member from the reel while the drive motor is rotating the drive member in the lowering direction.

2. The boat lift system of claim 1 wherein the cable slack control mechanism is operative to automatically selectively decouple the drive member from the reel while the drive motor is rotating the drive member in the lowering direction.

3. The boat lift system of claim 1 wherein the cable slack control mechanism is operative to decouple the reel from the drive member when a tension on the cable does not exceed a threshold tension and/or the cable is fully unwound from the reel while the drive motor is rotating the drive member in the lowering direction.

4. The boat lift system of claim 3 wherein the threshold tension is zero tension.

5. The boat lift system of claim 1 wherein the cable slack control mechanism includes at least one tooth and at least one pawl configured to mate with the at least one tooth.

6. The boat lift system of claim 5 wherein the cable slack control mechanism is configured such that the at least one pawl interlocks with the at least one tooth when the drive member is rotated in the raising direction and permits the at least one tooth to slip with respect to the at least one pawl when the drive member is rotated in the lowering direction while a tension on the cable does not exceed a threshold tension and/or the cable is fully unwound from the reel.

7. The boat lift system of claim 6 including a control sprocket including the at least one tooth, wherein the control sprocket is joined to the reel for rotation therewith.

8. The boat lift system of claim 7 wherein the drive member is a motor output shaft of the motor, and the drive system further includes:

a driven sprocket; and a drive sprocket operatively connected to the motor output shaft and coupled to the driven sprocket to transfer a drive force from the drive sprocket to the driven sprocket;

wherein the at least one pawl is mounted on the driven sprocket for rotation therewith.

9. The boat lift system of claim 8 including a gear reducer, wherein the motor output shaft is connected to the motor drive sprocket by the gear reducer.

10. The boat lift system of claim 8 including a drive chain, wherein the drive sprocket is coupled to the driven sprocket by the drive chain.

11. The boat lift system of claim 8 including a drive unit housing, wherein the driven sprocket, the at least one pawl and the control sprocket are housed in the drive unit housing.

12. The boat lift system of claim 11 including a support beam defining a channel, wherein the reel is rotatably mounted in the channel of the support beam and the drive unit housing is affixed to the support beam.

13. The boat lift system of claim 1 wherein the reel includes a helical surface groove configured to receive the cable therein when the cable is wound onto the reel.

14. The boat lift system of claim 1 wherein the motor is a reversible motor.

15. The boat lift system of claim 1 further including:

a second cable connected to the cradle; and a second drive system including:

a second reel configured to receive the second cable, the second reel being rotatable in each of a winding direction to wind the second cable onto the second reel to raise the cradle and an unwinding direction to unwind the second cable from the second reel to lower the cradle;

a second drive mechanism including a second drive member and a second motor operable to forcibly rotate the second drive member in each of a raising direction and a lowering direction, wherein the second drive member is operatively connected to the second reel to rotate the second reel in the winding direction when the second drive member is rotated in the raising direction, and to controllably rotate the reel and/or permit the second reel to rotate in the unwinding direction when the second drive member is rotated in the lowering direction; and a second cable slack control mechanism operative to selectively decouple the second drive member from the reel while the second drive motor is rotating the second drive member in the lowering direction.

16. A drive system for use with a cradle, a cable and a reel for raising and lowering a boat from and into a body of water, the cradle being configured to hold the boat, the cable being connected to the cradle, and the reel being configured to receive the cable and rotatable in each of a winding direction to wind the cable onto the reel to raise the cradle and an unwinding direction to unwind the cable from the reel to lower the cradle, the drive system comprising:

a drive mechanism including a drive member and a motor operable to forcibly rotate the drive member in each of a raising direction and a lowering direction, wherein the drive member is adapted to be operatively connected to the reel to rotate the reel in the winding direction when the drive member is rotated in the raising direction, and to controllably rotate the reel and/or permit the reel to rotate in the unwinding direction when the drive member is rotated in the lowering direction; and a cable slack control mechanism operative to selectively decouple the drive member from the reel while the drive motor is rotating the drive member in the lowering direction.

* * * * *